United States Patent [19]

Hitaka et al.

[11] 4,440,811

[45] Apr. 3, 1984

[54] METHOD FOR COATING AND AN APPARATUS FOR COATING

[75] Inventors: Yosatomi Hitaka, Hino; Takemasa Namiki, Iruma, both of Japan

[73] Assignee: Konishiroku Photo Industry Co., Ltd., Tokyo, Japan

[21] Appl. No.: 348,078

[22] Filed: Feb. 11, 1982

Related U.S. Application Data

[63] Continuation of Ser. No. 157,213, Jun. 6, 1980, abandoned.

[30] Foreign Application Priority Data

Jun. 13, 1979 [JP] Japan ..... 54-73465

[51] Int. Cl.[3] ..... B05D 1/26; B05D 1/34

[52] U.S. Cl. ..... 427/402; 427/420; 118/50; 118/410; 118/411; 118/412

[58] Field of Search ..... 427/420, 402; 118/407, 118/419, 50, 410, 411, 412

[56] References Cited

U.S. PATENT DOCUMENTS

| | | | |
|---|---|---|---|
| 3,413,143 | 11/1968 | Cameron et al. | 118/410 |
| 3,749,053 | 7/1973 | Timson | 118/412 X |
| 3,958,532 | 5/1976 | Timson | 118/412 |
| 3,993,019 | 11/1976 | Jackson | 118/411 X |
| 3,996,885 | 12/1976 | Jackson et al. | 118/411 X |
| 4,143,187 | 3/1979 | Pilgrim | 118/411 X |

FOREIGN PATENT DOCUMENTS

| | | | |
|---|---|---|---|
| 130409 | 3/1978 | Fed. Rep. of Germany | 118/412 |

*Primary Examiner*—Shrive P. Beck

*Attorney, Agent, or Firm*—Finnegan, Henderson, Farabow, Garrett & Dunner

[57] ABSTRACT

An improved method of coating one or more layer of a coating liquid onto a moving substrate from a coating hopper wherein coating bead of the coating liquid is formed and a part of the bead is formed at a side of entering of the substrate with respect to an efflux end of the coating hopper, and an end of the part of the bead being in contact with the coating hopper is held at a fixed position.

3 Claims, 7 Drawing Figures

METHOD FOR COATING AND AN APPARATUS FOR COATING

This is a continuation of application Ser. No. 157,213 filed June 6, 1980, now abandoned.

The present invention relates to improvement in coating method and apparatus. The invention particularly useful for coating onto a substrate wherein one or more layers of coating liquid are coated onto the substrate such as a support of a photosensitive material with a hopper such as a slide hopper, an extrusion hopper.

So far, for coating one or more layers onto a substrate, it is known a method in which a coating liquid supplied from the slide hopper or the extrusion hopper forms a coating bead bridging the hopper and a running substrate and a part of bead is formed at a side which the substrate enters, as described in the U.S. Pat. No. 2,761,419 and U.S. Pat. No. 2,761,791.

With these conventional technologies, however, various defects are caused on the coated layer formed on the substrate by coating of coating liquid if the said beads receive the disturbance or disorder. The defect that draws special attention, for example, is the occurrence of the streak defect in which the longitudinal streak appears and such occurrence of the streak defect may cause the serious results resulting in scrapping of products in coating manufacturing of the photosensitive material. And some of these streak defects occur after the start of coating and the other occur after the moment of passing the joint of the substrate to be coated or they occur after passing the foreign matter even in a normal coating if such foreign matter of dust is stuck to the substrate. And as for the occurrence of this streak defect, the faster and thinner is the coating, the more remarkable is the occurrence.

As a technology to prevent the occurrence of the said streak defect, various improvement technologies have been proposed. Namely, for example, [1] the technology to cause a pressure difference on the exposed surfaces of upper and lower parts of beads by causing vacuum on the surface of beads that suspends as disclosed in the U.S. Pat. No. 2,681,294, [2] the technology to apply oily-hydrophobic substance to the joint portion of the substrate to be coated and to give inclination in order to eliminate the wedge shaped space formed at the rear edge of the joint portion, as disclosed in Japanese Patent Publication No. 47-42725, [3] the technology to spray or coat water on the rear edge of the joint portion in order to make water adhere to the joint portion of the substrate to be coated as disclosed in Japanese Patent Publication No. 48-4371, and [4] the technology to arrange a lip at the efflux end of the coating liquid of the hopper and to increase the thickness of the layer of coating liquid on the top surface of the lip by forming so that the inclination angle of the top surface of the said lip is smaller than that of the efflux surface of the coating liquid and further the technology to round or to chamfer the tip edge of the lip in order to prevent the streak defect caused by a crack or a scratch caused by the sharpness of the tip edge of the lip in the said technology, have been proposed as disclosed in Japanese Patent Publication No. 51-39980.

However, following weak points were observed respectively on these improvement technologies.

Namely, in the said technology of [1], in case the pressure difference between upper and lower exposed surfaces of the beads portion is too small, it is necessary to increase the pressure difference by increasing the extent of vacuum because small difference of pressure is not sufficient to prevent the excessive vibration, but there is a danger that such increasing of the extent of vacuum itself may cause beads to have disorder and rupture. Meanwhile, in the said technology of [2], every joint on the substrate to be coated needs to have an applying work of oily-hydrophobic substance etc. and the technology has a weak point that the labor and time needed for the applying work are excessive. Further, in the said technology of [3], it is necessary to detect the joint portion of the substrate to be coated and to cause water to adhere uniformly to the joint portion and consequently the technology has a weak point that the costs of facilities and operation thereof are high. Furthermore, in the said technology of [4], in case the coating liquid contains silver particles like silver halide emulsion or other particles, the technology has a weak point that the sedimentation of these particles is apt to be accelerated at the horizontal portion formed on the top portion of the lip. And none of the technologies from [1] through [4] is useful for the prevention of the streak defect that occurs after the start of coating and in case of high speed thin film coating, in particular, it was difficult to prevent the streak defect. Further, even in the normal state of coating, the technologies were not useful for disturbance and disorder of beads caused when foreign matter such as dust etc. is stuck to the substrate to be coated and it was impossible to prevent the occurrence of the streak defect.

So, an object of the present invention is to prevent the occurrence of the streak defect in any case of the time of the start of coating, the moment of passing the joint portion and the moment of passing the foreign matter stuck to the substrate.

Further, another object is to provide a coating method wherein small-scale disturbance and disorder can be absorbed by beads and also the original state of formed beads can be restored immediately even if the beads are entirely destroyed by the passing of the joint portion etc, and an apparatus for the method.

Further, another object is to restrain the occurrence of the streak defect even in the case of high speed thin film coating.

A further object is to restrain the occurrence of the streak defect without applying a special treatment to the joint portion of the substrate like the said technologies of [2] and [3].

The foregoing and undermentioned objects are effected by holding an end of a coating bead at a fixed position of a hopper. In this invention the coating liquid supplied from the hopper forms a bead, a part of which is formed at a side which the substrate enters with respect to an efflux end of the supplied coating liquid. The end of the coating bead formed at the side is in contact with a part of hopper (which is called hereinafter as "coating surface"). The end of the coating bead can easily be held at the fixed position by being in contact with a liquid-end-holding portion arranged on a coating surface.

The present inventors considered that, as a result from the continuous studies on the aforedescribed occurrence of streak-defects, the cause of the said occurrence of the streak-defects is due to instability of the bead portion and position of the end of the bead portion is variable, and especially the end of the beads on the coating surface of the hopper side is likely to be irregular. Making more detailed explanation, in case of coating by making use of a conventional type of hopper, the end of the bead on the hopper side, which is formed the entering side of the substrate, is in contact with the coating surface, and that the position of the said end on the said coating surface is likely to move. It does not always clarify the above state in detail, because the beads portion is several hundreds microns in size therefore it cannot be observed with the naked eye, and it is difficult to illustrate because the size of the said beads portion varies with the variations of the viscosity, surface tension and angle of contact of the coating liquid, however, as for the conceptual diagram, FIG. 1 for example, may illustrate the said state.

In FIG. 1, 1 represents the hopper, 2 represents the efflux surface of coating liquid, 3 represents the running substrate to be coated, 4 represents the coating surface of the hopper and 5 represents beads. In this figure, the ending portion 5' of beads 5 is in contact with a substrate to be coated 3 and coating surface 4 and if beads 5 suffer disturbance and disorder, it is considered that the ending portion of beads 5 moves back and forth like the state of 5" or 5"' (this movement conceptually includes a vertical motion and is a back-and-forth motion when viewed from the entering side of the substrate), and further, when the joint portion of the substrate 3 passes, it is considered that the most of beads 5 are destroyed and it is difficult that the ending portion 5' of beads 5 restores again to the original state. The reason for this is considered to be that neither the coating surface 4 of the hopper nor the substrate 3 has a means to restore the rear edge portion 5' of beads to the original state. Therefore, in the case of coating by such hopper, there was no guarantee that the rear edge portion 5' of beads is restored to the original state if there are disturbance and disorder or destruction of beads.

The present invention is based upon the above described observations, and is accomplished in such the manners that if the disturbance and disorder of the beads are little, they may be absorbed at the end of the beads, and even if they are almost destroyed the end of the beads may immediately be restored to the original state. The present inventors are perhaps the first who have tried to coat with keeping the end of the beads at a fixed place. For example, even in the technology of the said improvement [4] that may be regarded at present as a very useful coating technology from the point of streak defect prevention and wherein the chamfering is done to prevent from streak defect and so on which may be caused due to the sharpness of the coating liquid extrusion outlet, it was difficult to hold the end of the beads at a fixed place or to restore the said end to the original state.

The present invention is hereby described further in detail in accordance with the FIG. 2–FIG. 7 illustrating the examples of the invention.

The coating liquid puddle 7 having the liquid-end-holding portion 6 is arranged and the said portion 6 holds the end of the said beads 5 in contact with the coating surface 4 of the hopper. The liquid end holding portion 6 of the invention may be the one that can hold the contacting end of the beads 5, for example, as shown in FIG. 2–FIG. 7, a right angled or a little more acute or obtuse angled point is formed on the coating surface 4 of the hopper by notching or scraping the said surface 4 and then the said point may be positioned at the end of the puddle 7. The angle of the point that serves as the liquid end holding portion 6 may vary with a viscosity and surface tension, etc. of coating solution, and the angle is arranged so that the contact end of the beads can be held at an contact angle as wider as possible. Generally preferable is a right angle.

Further, the following is a description of the coating liquid puddle 7 having the liquid end holding portion 6 in the invention, that is, for example, the coating surface 4 of the hopper is notched or scraped off at right angle upto a certain area as shown in FIG. 2; or, the coating surface 4 is notched or scraped off at right angle as shown in the said FIG. 2 and at the same time the inner portion alone of the side (the side of the liquid end holding portion 6) is broadly notched or scraped off, thereby the expanse 8 is made as shown in FIG. 3; or the inner portion alone of the side of the liquid end holding portion 6 is notched or scraped off as shown in FIG. 4; or the protruded portion 9 is formed on the coating surface 4, by which the puddle 7 having the liquid end holding portion 6 is formed as shown in FIG. 5; and so forth. Thus the coating liquid puddle 7 can be produced by having resort to measures as described above. In addition, the inner portion of the liquid end holding portion 6 may be a rounded portion 10 as shown in FIG. 6, for instance.

And, the present invention can be applied to not only the single layer type of multi-layer type slide-hoppers, but also the single-layer or multi-layer type extrusion hoppers and so forth. The example applied to an extrusion hopper is shown in FIG. 7, wherein the marks indicate the identical parts or names of parts with the aforesaid marks.

The example of the coating liquid puddle 7 having the liquid end holding portion 6 of the invention is as follows, for instance:

The length from the coating liquid efflux end to the position where the liquid end holding portion 6 is formed, that is, the length of the puddle 7 opposite the running substrate 3 (the length, a, in FIG. 2 and FIG. 7) is 20–1,000$\mu$, preferably 200–700$\mu$, and the length of the surface forming the liquid end holding portion 6 that is formed at the rear end of the said puddle 7, that is, the length from the inner portion on the side of the end of the puddle 7 to the liquid end holding portion 6 (the length, b, in FIG. 2 and FIG. 7) is 10–600$\mu$, preferably 30–100$\mu$. However, the said each length of a and b is determined appropriately in accordance with the viscosity and surface tension of the coating liquid, the kinds of the substrate 3 or the positioning of the hopper 1 to the substrate 3 or the covered roller 11 which makes the substrate run.

The coating liquid to be used in the invention is mainly of the water-soluble coating composites, but an organic or an inorganic liquid medium can be used. And, by making use of the present invention, it is possible to form the same or different type of coated layers on the substrate, and whether or not to mix those layers with each other.

The present invention is effective for manufacture of photographic material and also can be applied to many fields of coating or covering technics such as manufacture of an inorganic coated paper that requires one or more coating layers, and separated coating layers composing one or more different composites, for the purpose of giving a special nature to the products.

The present invention is effective for the manufacture of photographic materials as described above, and is suitable to produce the plural number of coated layers which are superimposed and coated with coating composites for photographic use onto a standard substrate for photographic use, that is a support, by applying with single layer or multi-layer coating. The coating composites for photographic use mentioned herein mean the liquid coating composites which form not only a silver halide emulsion layer and other photographic light sensitive layers but also a non-light-sensitive layer such as subbing layer, interlayer or protective layer. The viscosity of such coating composite for photographic use is at the order of approx. 2–150 cp in general, but most popularly at the order of 5–100 cp.

The substrate to be coated which the present invention is applied to may be either one of all sorts of synthetic resin sheets, papers and metals, etc. which are well known as the supports for photographic use and also may be the supports for coated layer for the other use than the photographic use. And, this substrate may also have one or more covered layers which are in the substantially dried state. Further, the coating liquid to be used in the invention contents the photosensitive materials such as silver halide, zinc oxide, titanium dioxide, diazonium salt and sensitizing dye, etc. as well as an independent or two or more mixed materials which are known as the additives for photographic use.

For the purpose of confirming the advantages of the present invention, following the process thereof, the coating composite containing gelatin served as the binder was coated over the synthetic resin support (substrate) at the multiple layer coating speed (CS) of 50 m/min, and it was found therefrom that the streak defect was checked completely or at the minimum, in comparison with the results from the other usual method than that of the present invention but in the same coating conditions, that is, the results from that the coating was done by the hopper as shown in FIG. 1 and after the usual coating method, for example. Further the satisfactory coated matter could be obtained even in applying a faster coating speed than usual. And the capability of the hopper of usual type was not spoiled.

That is, the aforementioned objects of the present invention can be accomplished by the method of this invention, for which reasons are as follows:

Even if the beads, which are formed on the substrate feeding side behind the coating liquid efflux end of the hopper, are disturbed or disordered, of which contact portion to the substrate moves, the contact portion of the beads to the coating surface of the hopper does not move as being held in contact with the liquid end holding portion, because of the fact that the rear end of the said beads is held in contact with the liquid end holding portion of the coating liquid puddle formed on the coating surface of the hopper, and further the rear end contact portion of the beads on the side of the said liquid end holding portion pulls back the movement of the contact Portion of the said beads to the substrate and then restores to the original state. And should the beads by completely destroyed by passing the joint section of the substrate, the rear end of the beads will immediately revert up to the said liquid end holding portion, restore to the original state and put in uniform order. Therefore, in the present invention, the rear end of the beads can be restored to the original state as same as the state of regular coating, and coated with putting them in uniform order, and the occurrence of streak defect can be checked completely or at the minimum, even if the beads should be disturbed or disordered or should the beads be destroyed, not to mention the regular coating state.

Figure 1:
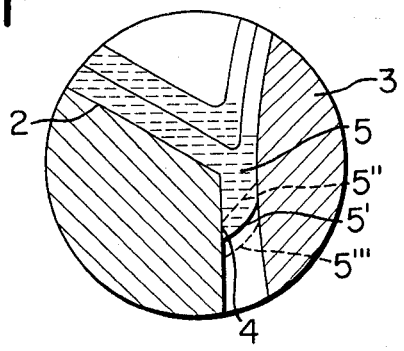
FIG. 1 is a partly diagrammatic sectional side view of an apparatus for coating which is known so far, wherein a coating liquid efflux surface, a portion of a coating surface and a portion of a substrate of a slide hopper are shown enlargedly.
Figure 1:
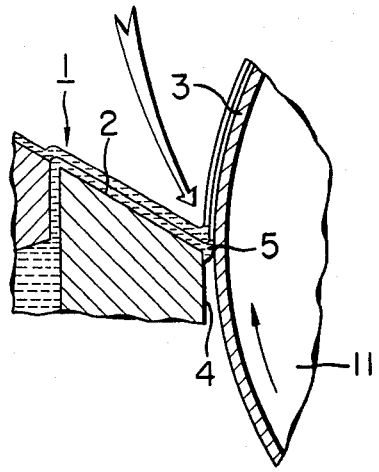
Figure 2:
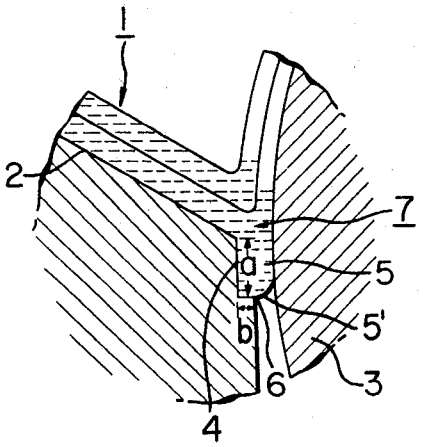
FIG. 2–FIG. 6 are the respective enlarged sectional side views of the typical examples of some portions of a slide hopper to be applicable in the method of the present invention.
Figure 3:
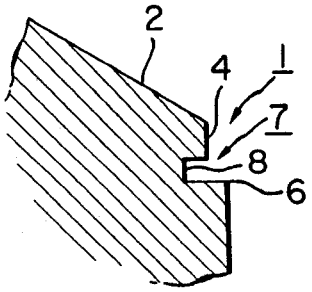
Figure 4:
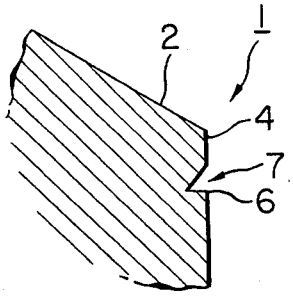
Figure 5:
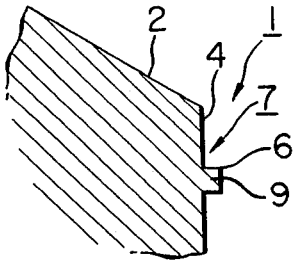
Figure 6:
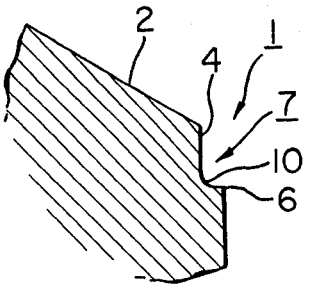
Figure 7:
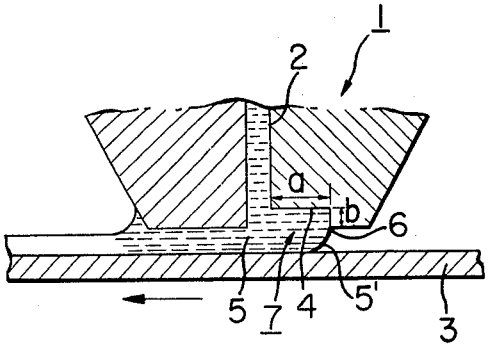
FIG. 7 is a partly diagrammatic sectional side view of a coating machine having an extrusion hopper to be applicable in the method of the present invention.

Wherein, 1 represents a hopper, 2 represents a coating liquid efflux surface, 3 represents a substrate to be coated, 4 represents a coating surface of a hopper, 5 represents beads, 5', 5'' and 5''' represent an end of beads respectively, and 6 represents a liquid-end-holding portion.

What is claimed is:

1. A method for reducing streak defects during the coating of one or more layers of a coating liquid onto a moving substrate from a coating hopper having a coating surface comprising the steps of:

supplying a coating liquid from an efflux end of a coating hopper as a layer;

forming a bead of the supplied coating liquid, said bead bridging the coating hopper and the substrate with part of said bead formed at an entering side of the substrate relative to the efflux end and an end of said bead at the entering side in contact with the hopper;

holding said end of said bead at a liquid end-holding portion of a liquid puddle arranged on the coating hopper, said liquid end-holding portion being formed on said coating surface of the coating hopper by notching said coating surface, said notched coating surface containing an interfering surface substantially perpendicular to the flow of said layer of coating liquid, said interfering surface interfering with the flow of said layer of coating liquid; and moving the substrate in contact with the coating liquid so that the substrate is coated with the coating liquid.

2. A method according to claim 1 wherein the substrate is a photographic support.

3. A method according to claim 1 wherein the coating liquid has a viscosity of 2–150 cp.

* * * * *